US005411164A

United States Patent [19]

Smith et al.

[11] Patent Number: 5,411,164

[45] Date of Patent: May 2, 1995

[54] LAUNDRY AREA ORGANIZER DISPOSED BETWEEN A CLOTHES WASHER AND DRYER

[76] Inventors: Paul C. Smith, Box 1200, Occidental, Calif. 95465; Barbara J. Smith, Box 120, Camp Meeker, Calif. 95419

[21] Appl. No.: 25,218

[22] Filed: Mar. 1, 1993

Related U.S. Application Data

[63] Continuation-in-part of Ser. No. 759,420, Sep. 13, 1991, abandoned.

[51] Int. Cl.[6] ..... A47B 41/00

[52] U.S. Cl. ..... 220/334; 312/290

[58] Field of Search ..... 312/290; 220/334

[56] References Cited

U.S. PATENT DOCUMENTS

| | | | |
|---|---|---|---|
| 1,573,466 | 2/1926 | Ward | 312/290 X |
| 2,401,526 | 6/1946 | Ullman | 312/290 X |
| 2,480,045 | 8/1949 | Reeves | 312/290 X |
| 2,895,782 | 5/1959 | Fragale | 312/290 |
| 3,261,651 | 7/1966 | Prowse | 312/290 |
| 5,090,785 | 2/1992 | Stamp | 312/290 X |

*Primary Examiner*—Steven M. Pollard

[57] ABSTRACT

The LAUNDRY AREA ORGANIZER includes a bin having a front, a back, a bottom, and first and second side walls, the first side wall of the bin being juxtaposed to and abutted with a side wall of one of the clothes washer and dryer and the second side wall of the bin being juxtaposed to and abutted with a side wall of the other of the clothes washer and dryer so that the bin is disposed between and laterally supported by the clothes washer and dryer. The LAUNDRY-AREA ORGANIZER also includes a cover for the bin, the cover having a top surface, the cover being manipulable to an open position for providing access to the interior of the bin and, alternatively, to a closed position for precluding access to the interior of the bin, the top surface of the cover is at about the same height as the top surfaces of the clothes washer and dryer so that the top surfaces of the cover and the clothes washer and dryer lie approximately in a plane, to provide a continuous work surface.

20 Claims, 13 Drawing Sheets

LAUNDRY AREA ORGANIZER DISPOSED BETWEEN A CLOTHES WASHER AND DRYER

CROSS-REFERENCE TO RELATED APPLICATION

This application is a CONTINUATION-IN-PART of U.S. patent application Ser. No. 07/759,420, filed on Sep. 13, 1991, entitled "DETERGENT BIN" in the names of Paul C. Smith and Barbara J. Smith.

BACKGROUND—FIELD OF INVENTION

This invention relates to storage and bin-type receptacles; more particularly, to receptacles for storage of powdered and liquid detergents, fabric softening agents, bleaching and stain removing agents, and the like, prior to use, and for facilitating their dispensing and use. Specifically, one embodiment of the invention is directed to a LAUNDRY AREA ORGANIZER for laundering agents that is configured to be positioned between and laterally supported by a clothes washer and dryer to provide storage of and, when open, convenient access to the laundering agents, and a continuous work surface when closed.

BACKGROUND—HISTORY

For over 50 years powdered-form detergents have been packaged for domestic consumer use mainly in relatively small cardboard cartons. For many years, a 6-pound package of detergent was considered large, or "giant economy size" in the vernacular of the advertising world. These modest sized cartons were stored on shelves, in cabinets, or on the counter or floor near the clothes washer or on top of the clothes dryer. The user typically dispensed detergent by pouring through a "punch-out" opening on the side or top of the carton into a measuring cup, then pouring the measured amount into the clothes washer. This process was a bit awkward, and spills were common when the carton was accidentally knocked over. A sprinkling of detergent on washer top, counter, and floor was the norm.

In an attempt to improve or simply vary this process, manufacturers tried compressing detergent into one load tablets. They also began to market liquid form detergent. The tablets seem not to have been widely accepted, but liquid detergent has become commonplace.

In the last 30 years, the available types of detergents haven't changed. Likewise, there has been little change in the options offered to consumers for storing and dispensing laundering agents. However, the way detergent is marketed has changed dramatically, and the variety of agents available has multiplied. As a result the problems of storing and using these laundering agents have multiplied, and until now no comprehensive solution has emerged.

Sears and Roebuck has for many years quietly marketed powdered detergent in 20- to 40-pound containers. This appealed to consumers wanting the economy of this bulk purchase and the convenience of seldom running out. However, storage and dispensing was a much greater problem than with the common, smaller cartons.

The 1980's brought something of a revolution in retailing with the advent of "warehouse"-type outlets that combine large purchasing power with multiple or bulk packaging to reward the shopper with lower per-unit prices. Acceptance of this form of retailing has been widespread: there are now nearly 1000 of these "warehouse" stores in the United States.

Detergent fit naturally into this scheme of merchandising, and today, powdered detergent is widely sold through this type of retail operation in 10- to 50-pound cartons or plastic buckets. Initially, this was "private label" detergent. In response, most major detergent brands have added 18- to 24-pound units that can be found in most large supermarkets as well as the "warehouse" stores. Liquid detergent has "grown" too. 64-oz. bottles are common everywhere, and 2-gallon (256 oz.) bottles that push the practical limit for dispensing can be found in most "warehouse" stores. Bleaches in liquid and powdered form, liquid and "dryer sheet" fabric softening agents and stain removers are also available in large units and are now commonplace in the home laundry room.

To the consumer, the availability of these larger units means economy, fewer trips to the store and seldom running out of these "necessities". It also means a proliferation of large containers in the laundry area that are difficult to store accessibly, and new or significantly increased dispensing problems.

Most shelves and cabinets in the home don't work well for storing these large containers, particularly the powdered detergent containers. 20- to 40-pound units are difficult to manage and take up a lot of valuable work space on top of the dryer or counter. Therefore, they are often left on the floor where they are, at the least, an obstacle and, at worst pose a hazard to small children. A container on the floor may require tedious opening and closing with each use. Additionally, the user must bend over to scoop detergent at near floor level. Some of the detergent invariably is scattered about the area.

The organization of the area and the real work of transferring clothes to the appliances, sorting, and folding the laundry is impeded by the presence of this multitude of large containers.

These real problems now exist without solution, while millions of consumers struggle with them daily. The perception of these problems no doubt keeps many more consumers from enjoying the savings and other benefits offered by purchasing laundering agents in bulk.

PRIOR ART

Although the prior art discloses receptacles for the laundry area, no known prior art receptacles are intended to contain laundering agents. For example, Fragale, U.S. Pat. No. 2,895,782, discloses a clothes hamper having compartments for sorting soiled clothes into single sized loads for a clothes washer and is therefore not adapted to contain laundering agents. Moreover, the resulting clothes hamper disclosed in this patent is free-standing and occupies a substantial amount of floor space in the home laundry area.

The applicants are unaware of any prior art that relates to storage of laundering agents in a receptacle designed to conserve floor space by fitting juxtaposed and in between a clothes washer and dryer.

OBJECTS AND ADVANTAGES

Accordingly, one embodiment of the invention provides a LAUNDRY AREA ORGANIZER to provide a solution for these problems. The objectives are to provide to the user of domestic laundry appliances a means for storing relatively large quantities of various laundering agents in readiness prior to use that:

A. Is in the most convenient location possible considering the intended use of the stored agents (juxtaposed and in between a clothes washer and dryer);

B. Is of sufficient narrowness that the clothes washer and dryer remain in close proximity so that the movement of clothes between appliances is unimpeded, yet wide enough to provide easy access and the required capacity (for example, 5" is a practical inside minimum width). The LAUNDRY AREA ORGANIZER of the present invention, due to this narrowness relies on the clothes washer and dryer for lateral support and stability;

C. Is easy to load from the large cartons and buckets of powdered detergent available;

D. Is quick and easy to open, dispense from, and close;

E. Allows the storage of up to about 50 pounds of powdered detergent so a user need not store partial containers; or F. Allows users the option to store a variety of agents in separate chambers and allows users to adjust the number and capacity of these separate chambers;

G. Stores these agents at approximately the level of use (e.g., top of the clothes washer) with a maximum depth allowing most adults to retrieve detergent with little or no bending or excessive reaching (about 36" in height equals that of standard U.S. domestic laundry appliances. For example, 16" has proved to be a practical depth for the bin of the LAUNDRY AREA ORGANIZER;

H. Is attractive and harmonious when placed between a clothes washer and dryer; therefore the current embodiment closely replicates the height (about 36"), depth (about 26") and finish of these appliances; also, the finish of some or all exposed areas of the LAUNDRY AREA ORGANIZER could replicate that of the cabinet work in the area;

I. Provides an approximate continuation of the upper work surfaces of the clothes washer and dryer, so that with the cover in place, this overall work surface is, for practical purposes, continuous and usable;

J. Is easy-to-use, versatile, inexpensive to manufacture, and usable in the majority of home laundry areas;

K. Offers storage areas inaccessible to small children;

L. Is adaptable to a variety of construction materials and methods;

M. Allows clearance for plumbing, dryer ducts, and electrical wiring;

N. Eliminates the need to store containers on the floor in front of appliances or on top of the appliances or adjacent counter tops where work space is always at a premium;

O. Could become the centerpiece of a system of containers of laundering agents designed as "drop-in" loads;

P. Could allow use of space in the support area under the bin for additional storage, a holder to allow dispensing of fabric softener "dryer sheets" or other sheet goods, or a built-in refuse container especially adapted for the discarding of dryer lint; embodiments of the current invention allow storage and dispensing of "dryer sheets" and/or disposal of lint and refuse just inches from the dryer access;

Q. Could reduce environmentally unsound, wasteful packaging;

R. Helps to organize the laundry area thus making a job millions execute daily go smoother.

One embodiment of the invention provides a LAUNDRY AREA ORGANIZER for use with a clothes washer and dryer, each of the clothes washer and dryer having a top surface and side walls, the laundry area organizer configured to be located between the clothes washer and dryer. The LAUNDRY AREA ORGANIZER comprises a bin that includes a front, a back, a bottom, and first and second side walls, the first side wall of the bin being juxtaposed to and abutted with a side wall of one of the clothes washer and dryer and the second side wall of the bin being juxtaposed to and abutted with a side wall of the other of the clothes washer and dryer so that the bin is disposed between and laterally supported by the clothes washer and dryer, the front, back, and first and second side walls of the bin defining an interior chamber. The LAUNDRY AREA ORGANIZER also includes a cover for the bin, the cover having a top surface, the cover being manipulable to an open position for providing access to the interior of the bin and, alternatively, to a closed position for precluding access to the interior of the bin. Finally, the LAUNDRY AREA ORGANIZER includes a plurality of legs for the bin for vertically supporting the bin so that the top surface of the cover is at about the same height as the top surfaces of the clothes washer and dryer so that the top surfaces of the cover and the clothes washer and dryer lie approximately in a plane. Therefore, the LAUNDRY AREA ORGANIZER is disposed between and laterally supported by the clothes washer and dryer with the top surface of the cover preferably at the same height as the top surfaces of the clothes washer and dryer to provide a continuous work surface. Preferably, dividers can be slid into slots within the interior chamber to provide separate compartments for storage of different laundering agents. Additionally, the back can be tapered in towards the front to the junction of the back and the bottom thereby offsetting a back leg toward a front leg to provide clearance for utilities behind the LAUNDRY AREA ORGANIZER. Also, a refuse container can be disposed in the front leg of the LAUNDRY AREA ORGANIZER. Furthermore, the front leg or the refuse container can be provided with a holding means on the interior, on which a dispenser carton or a roll of sheet material can be held, such that the sheet material can be dispensed through a slot provided in the front leg or the front of the refuse container.

BRIEF DESCRIPTION OF THE DRAWINGS

FIG. 1 is a front top perspective view of the assembled LAUNDRY AREA ORGANIZER shown in the requisite environment as it might appear if fabricated from wood product panels, sheet metal, or sheet plastic.

FIG. 3 is a front top perspective view of a LAUNDRY AREA ORGANIZER in its requisite environment as it might appear if manufactured by plastic injection molding with external structural ribs.

FIGS. 4–18 show a currently preferred embodiment of the LAUNDRY AREA ORGANIZER of the current invention as it would appear if manufactured by plastic injection molding:

FIG. 4 is a front top perspective view of the present preferred embodiment of the LAUNDRY AREA ORGANIZER shown in the requisite environment.

FIG. 5 is a front top perspective exploded view of the LAUNDRY AREA ORGANIZER of FIG. 4.

FIG. 6 is a right side assembly view with cutaway to show the fastening arrangement.

FIG. 7 is a front assembly view with cutaways to show the fastening arrangement and the interior rib and divider panel arrangement.

FIG. 8 is a front sectional view of the bin only at line A—A in FIG. 6.

FIG. 9 is a front view of a divider panel.

FIG. 10 is a top view of a divider panel.

FIG. 11 is a top view of the bin.

FIG. 12 is a bottom view of the bin.

FIG. 13 is a bottom view of the cover.

FIG. 14 is a side view of the cover.

FIG. 15 is a front top perspective view of a front leg with a tilt-out waste bin incorporated in a frontal rectangular opening.

FIG. 16 is a cross section at the line B—B in FIG. 15.

FIG. 17 is a rear perspective view of the front leg with an integrally molded bracket and a spring wire bale, a detachable spindle, or a detachable vertical extension bracket as preferable alternatives for holding sheet materials for dispensing.

FIG. 18 is a rear perspective view of the front leg with a detachable bracket for holding sheet goods for dispensing.

DETAILED DESCRIPTION OF THE PREFERRED EMBODIMENTS

Figure 1:
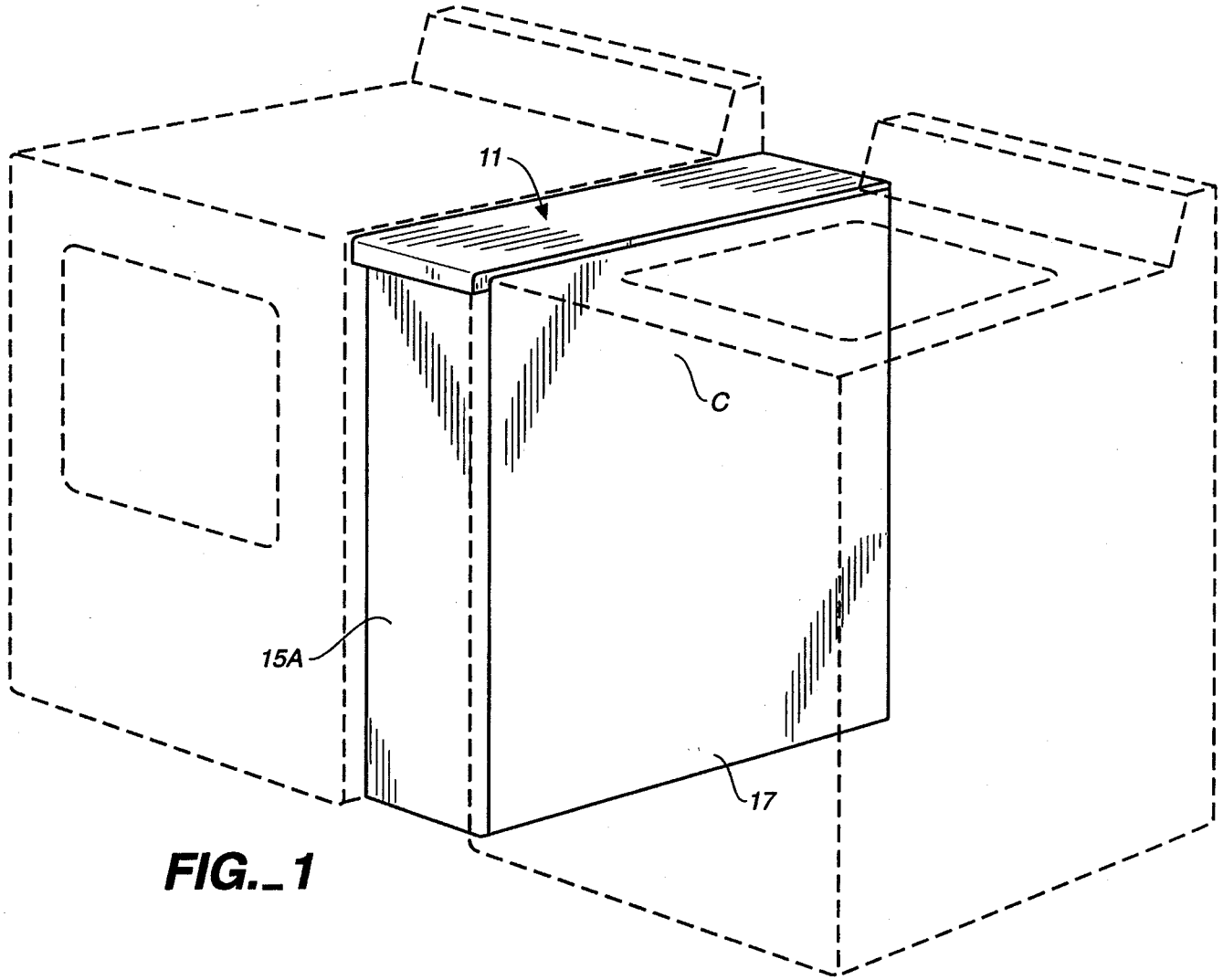
In FIGS. 1, 3, and 4 the broken lines showing the clothes washer and dryer are for the purpose of illustrating the requisite environment only.
Figure 2:
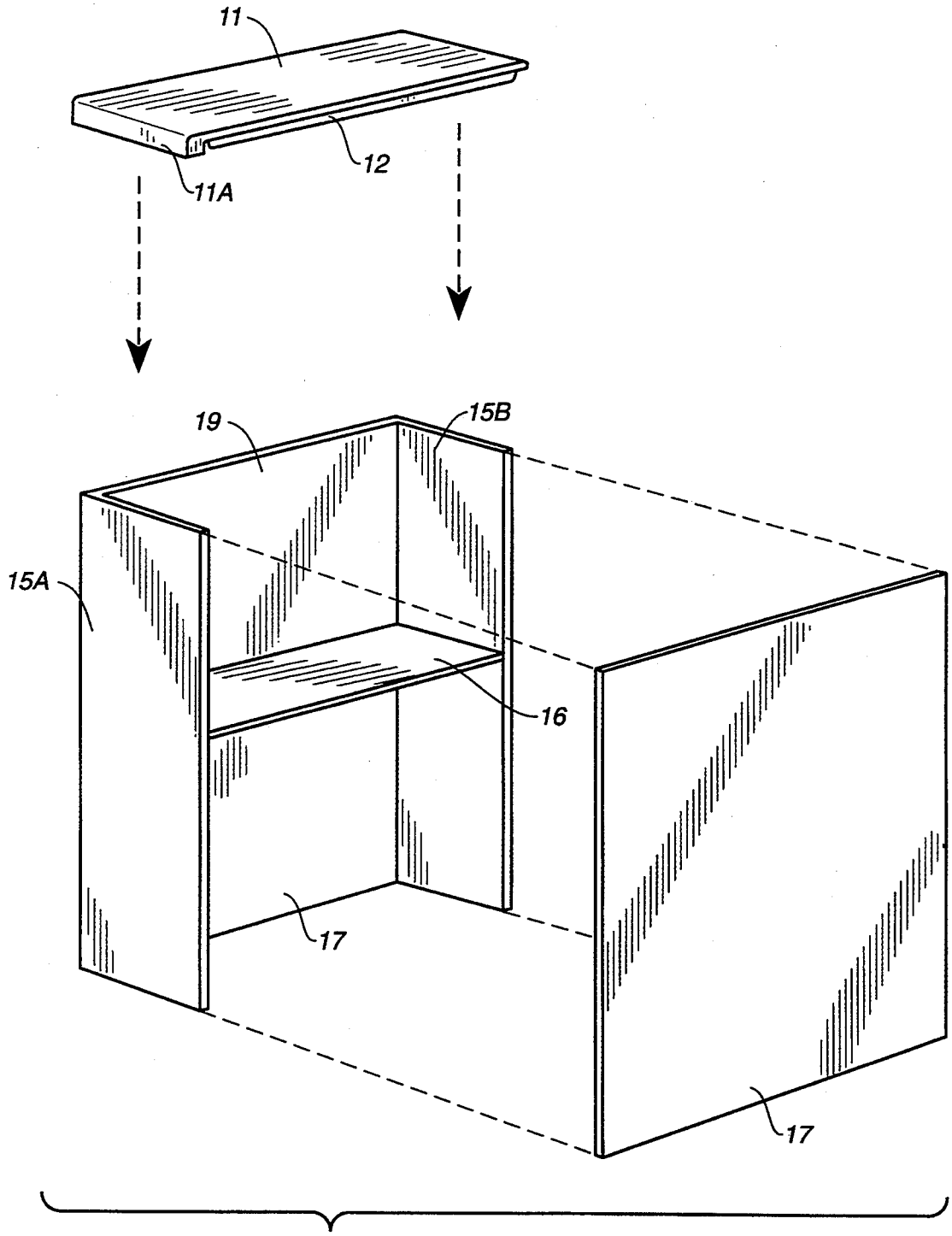
FIG. 2 is a front top exploded perspective view of the LAUNDRY AREA ORGANIZER of FIG. 1.

FIGS. 1 and 2 show one embodiment of the LAUNDRY AREA ORGANIZER of the present invention as it might appear if manufactured from sheet goods such as wood product panels and laminates, and sheet plastic or metal. Front and back panels 15-A and 15-B join side panels 17 and bottom 16 to create a storage chamber 19. Vertical dados cut in or vertical cleats affixed to the side panels 17 could locate one or more movable vertical divider panels to create a plurality of compartments as in the embodiments to follow. Divider panels could also be non movable.

A cover 11 having an integral or attached handle 11-A and guides 12 allows easy access to stored laundering agents such as liquid or powdered detergent, bleach, or fabric softener. The cover 11 may be lifted by the handle 11-A to a suitable position for dispensing, or completely removed during a filling or loading process.

Figure 3:
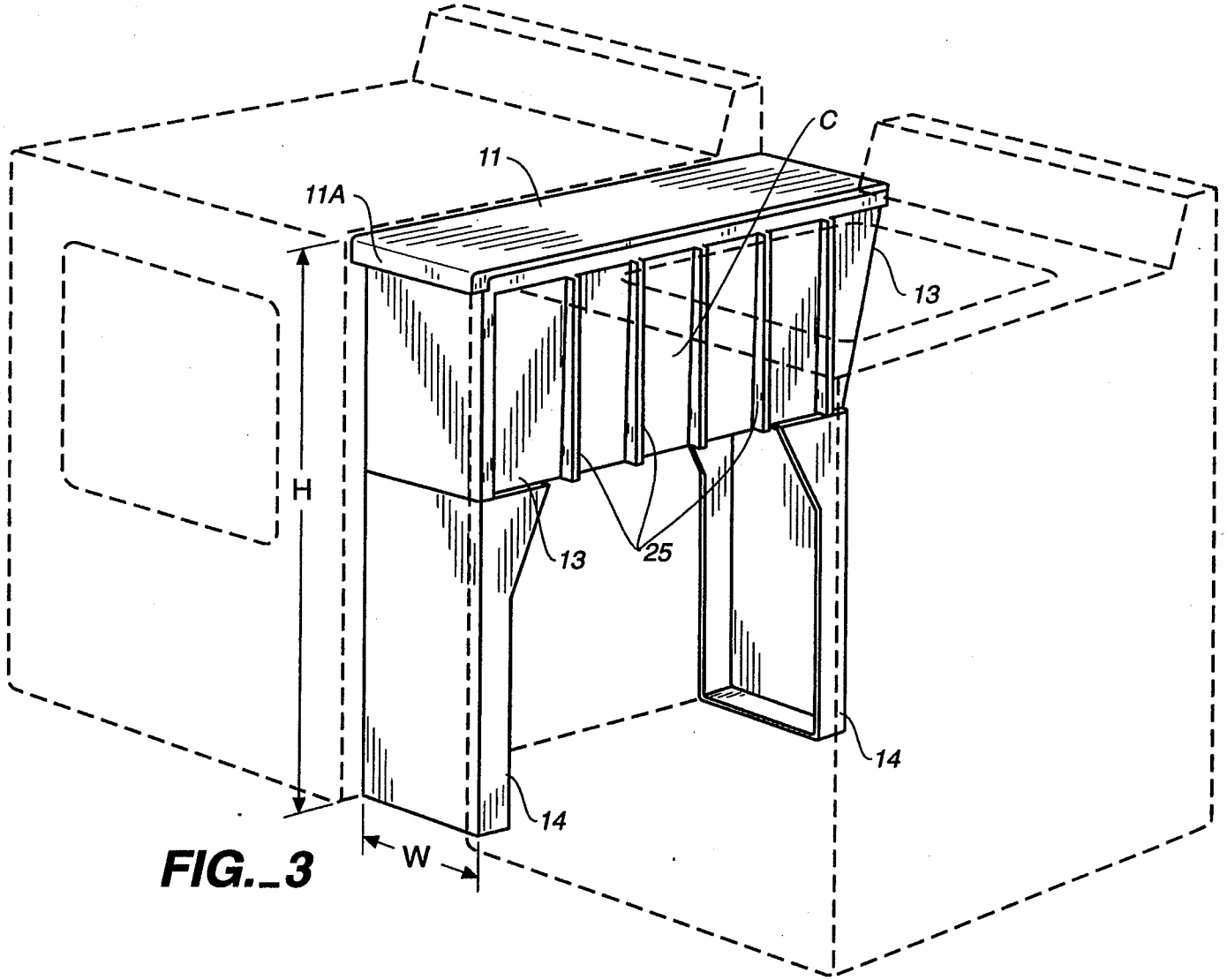

FIG. 3 shows an embodiment of the current application as it might appear if manufactured by plastic injection molding using exterior structural ribs 25. The bin 13 as shown is a separate unit, the supporting means, legs 14, being detachable. The cover 11 is a single molding including the handle 11-A and the guides 12, not see here.

Figure 4:
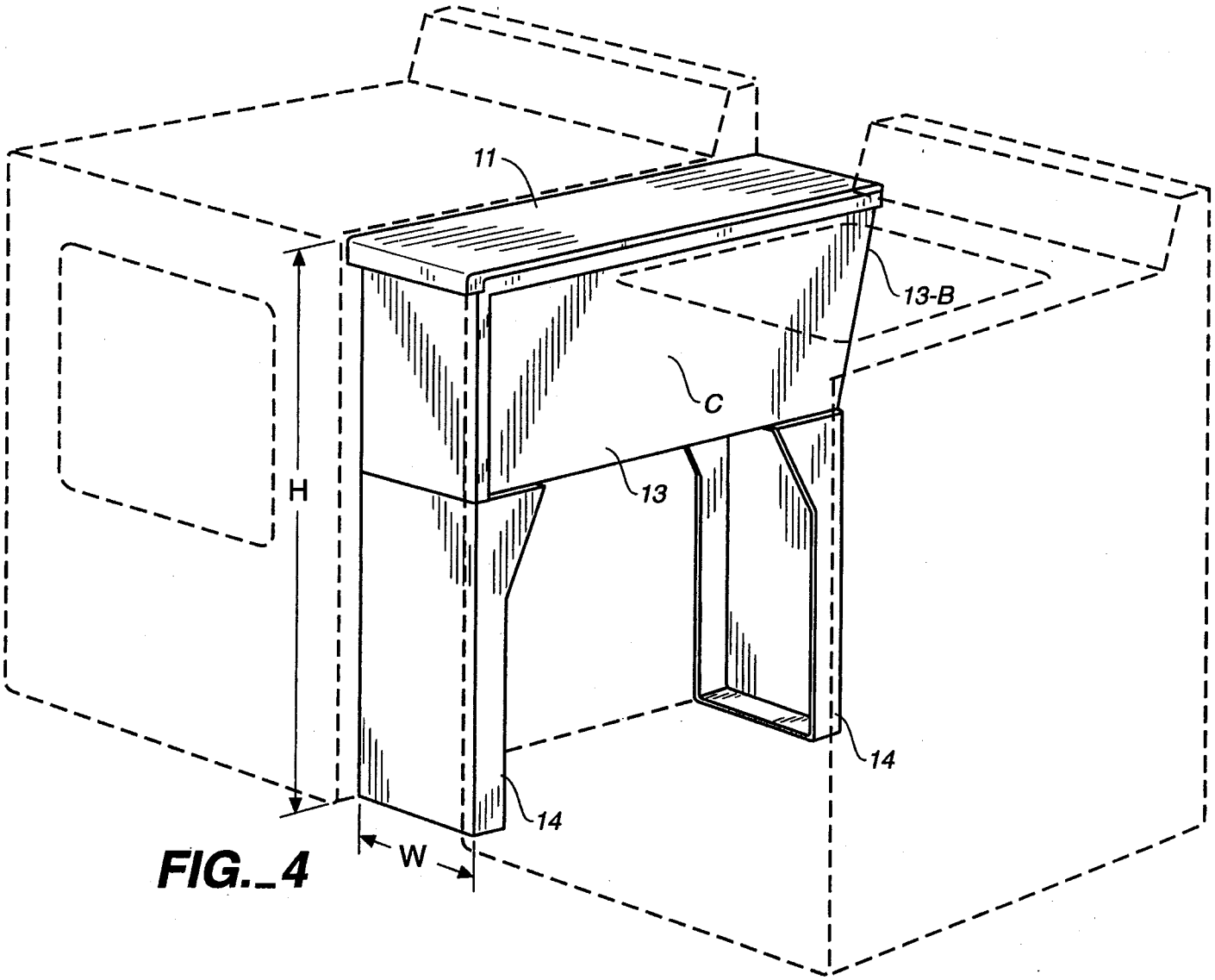

The broken lines in FIGS. 1, 3, and 4 showing the clothes washer and dryer indicate the requisite environment of the LAUNDRY AREA ORGANIZER. While the clothes washer and dryer are not any part of the present invention, the LAUNDRY AREA ORGANIZER is reliant on disposition between these appliances for lateral support and stability, as will be described in more detail below.

FIG. 4 shows a LAUNDRY AREA ORGANIZER in accordance with the preferred embodiment of the present invention, in the requisite environment, comprising a one piece molded cover 11, a one piece bin 13, detachable legs 14, shown here as identical and interchangeable, as a supporting means, and internal parts and hardware not seen here. All are designed for efficient plastic injection molding. The bin lower back 13-B preferably slopes inwardly toward the front of the assembly, effectively insetting the rear leg 14 thereby providing clearance for plumbing, dryer ducts, and electrical connections that might otherwise prevent the assembly from being situated as near to the wall behind as might be desired.

Figure 5:
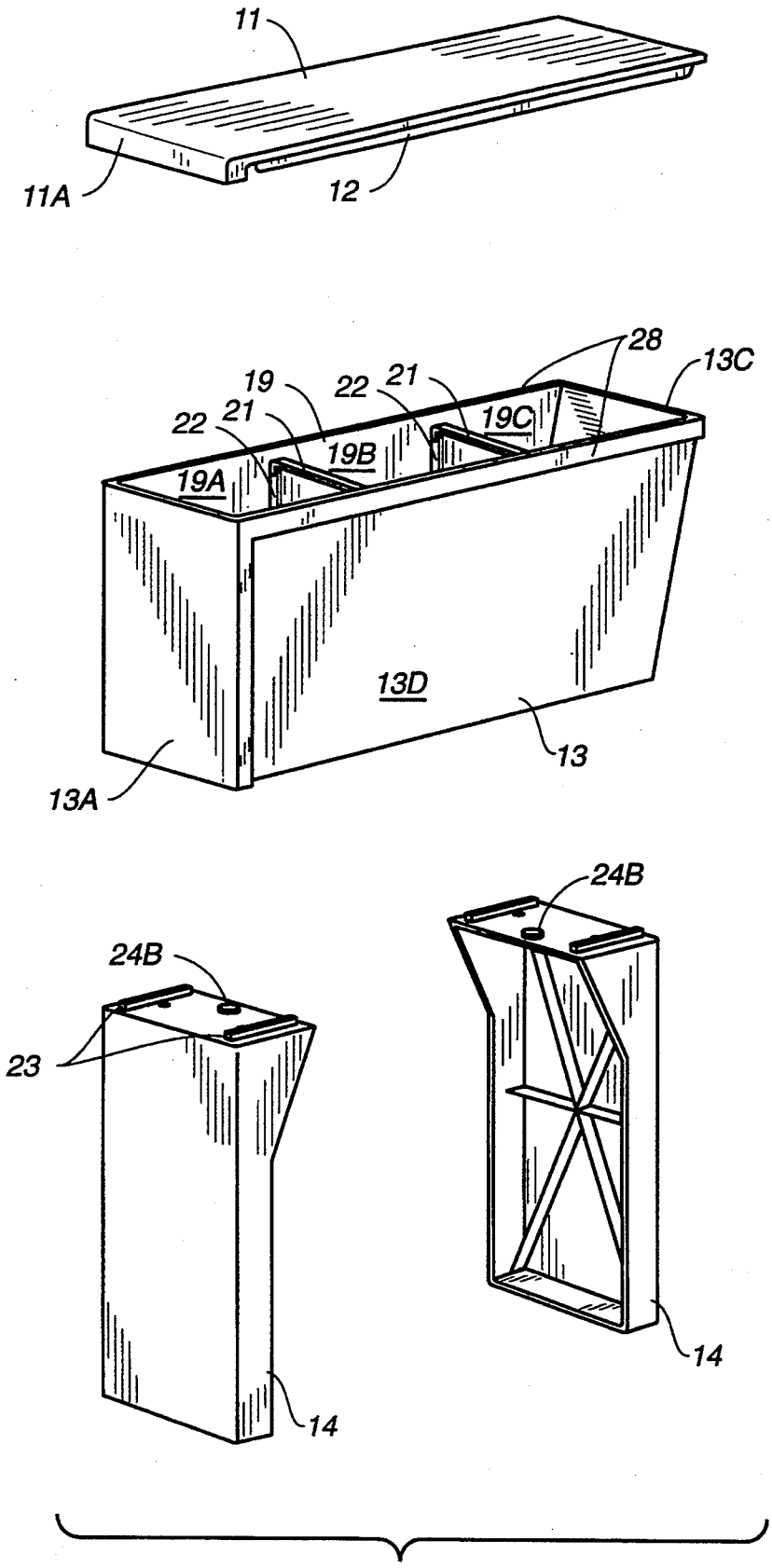

FIG. 5 illustrates the LAUNDRY AREA ORGANIZER of FIG. 4 in exploded view. The one piece molding of the cover 11 includes a handle 11-A, and guides 12 that, by projecting downwardly into the storage chamber 19, locate the cover 11 on the bin 13 as the cover 11 is lowered after dispensing or replaced after removal for loading laundering agents. These guides 12 also function as structural components adding stiffness to the cover 11. As the cover 11 is lifted by the handle 11-A, these guides 12 bear on the interior of the substantially vertical upper back 13-C of the bin 13, allowing the cover 11 to be lifted almost vertical, and well beyond the required elevation for dispensing, before the guides 12 lose their bearing on the upper back 13-C.

The bin 13 illustrated is a one piece molding that forms the storage chamber 19. Side channels 28 are preferably provided to resist the pressures imposed by the contents on the opening of the storage chamber 19. Additionally, pairs of vertical interior ribs 22 provide the required structural rigidity to the sides of the bin 13, as well as serve to locate and retain divider panels 21 that provide the option of dividing the storage chamber 19 into a plurality of compartments 19-A–19-C. Two divider locations are herein illustrated: more would of course be possible, depending on requirements.

Figure 12:
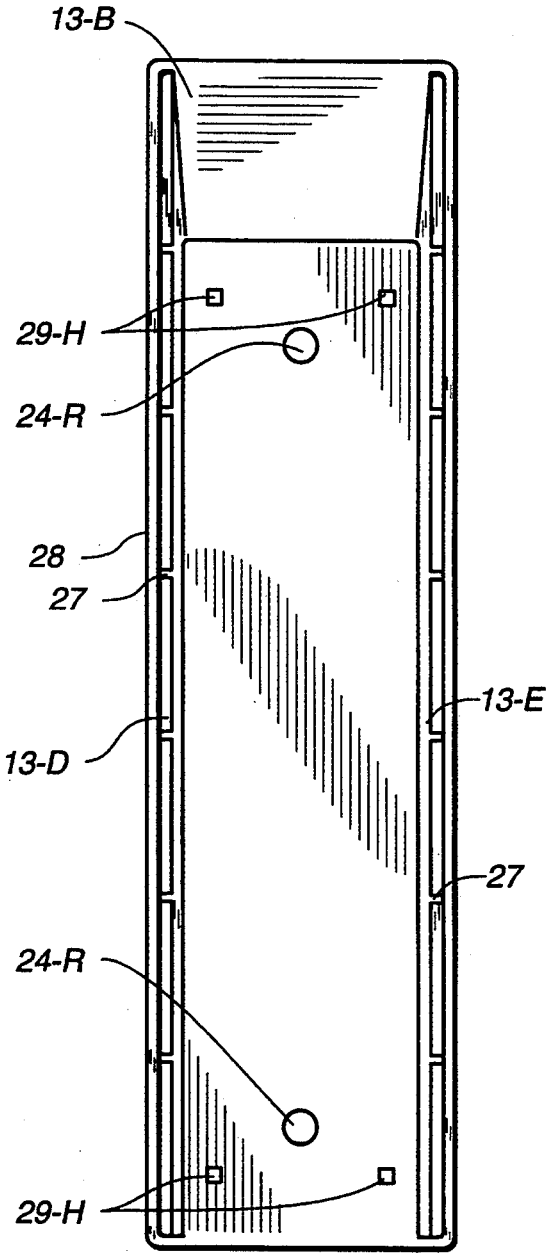

The front 13-A of the bin 13 as shown is vertical and of uniform width. The front of the leg 14 is also vertical and of the same width. In the assembly process, the leg 14 and the bin 13 are precisely aligned by locating ribs 23 in between which the bin 13 tightly fits, and locating bosses 24-B on the leg 14 which mate with locating recesses 24-R on the bin 13 (FIG. 12). A visually continuous vertical front is thus formed by the leg 14 and the front 13-A of the bin 13. The resulting appearance of the LAUNDRY AREA ORGANIZER, in white or almond molded plastic, is aesthetically very compatible with appliances of similar colors between which the assembly is disposed as shown in FIG. 4.

The combined height H of the assembly is approximately equal to a U.S. standard laundry appliance, or about 36" so that the top surface of the cover coincides with the top surfaces of the clothes washer and dryer as shown in FIG. 4. While the height of a laundry appliance may vary with the use of the leveling feet with which most such appliances are provided, in practice, achieving an exact match with the height of the appliances is not a requirement of the serviceability or visual compatibility of the LAUNDRY AREA ORGANIZER. Therefore, a leveling or height adjusting means, while possible, has not be incorporated into the present preferred embodiment.

As shown in FIG. 4, the height H is substantially greater than the width W of the LAUNDRY AREA ORGANIZER. For example, while height H is approximately 36", the width W is approximately 6" for convenient location of the LAUNDRY AREA ORGANIZER between the clothes washer and dryer shown in broken lines in FIG. 4. This allows the clothes washer and dryer to remain in close proximity so the transfer of clothes from the washer to the dryer is not substantially impeded.

Additionally, when the LAUNDRY AREA ORGANIZER is filled with laundering agents, such as detergents, bleach, and fabric softener, the LAUNDRY AREA ORGANIZER has a high center of gravity C. Therefore, the LAUNDRY AREA ORGANIZER relies on abutting contact of bin sides 13-D and 13-E (FIGS. 5, 6, 7, and 12) with the juxtaposed walls of the clothes washer and dryer shown in FIG. 4 for lateral support.

Figure 6:
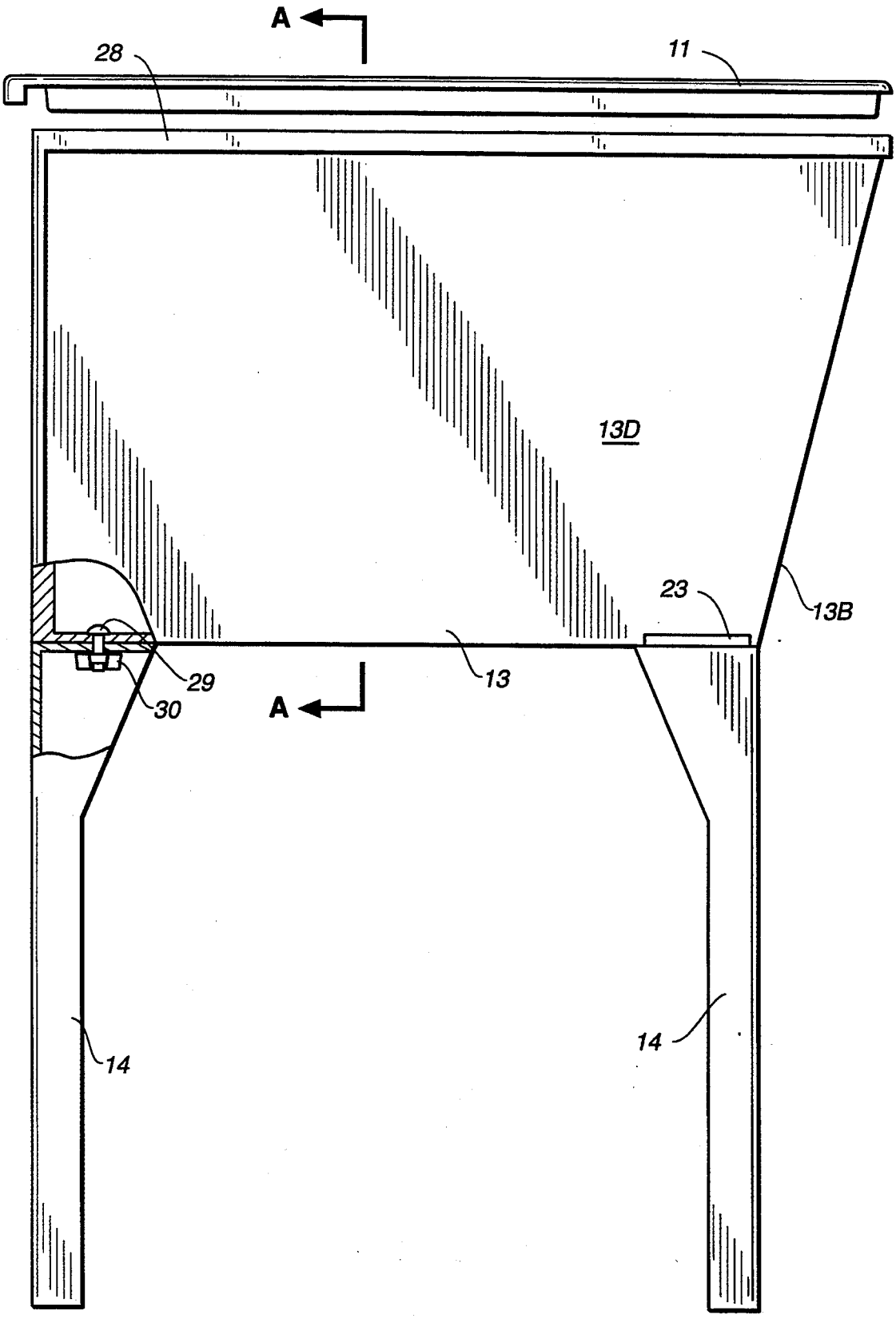

FIG. 6 shows a side view of the bin 13 and leg 14 assembly, with cover 11 above. A section where the leg 14 joins the bin 13 is cut away to show a carriage bolt 29 and wing nut 30 connection of the present embodiment. In practice, a nylon wing nut mated to a steel carriage bolt has proved easy to install without tools and is vibration resistant.

Figure 7:
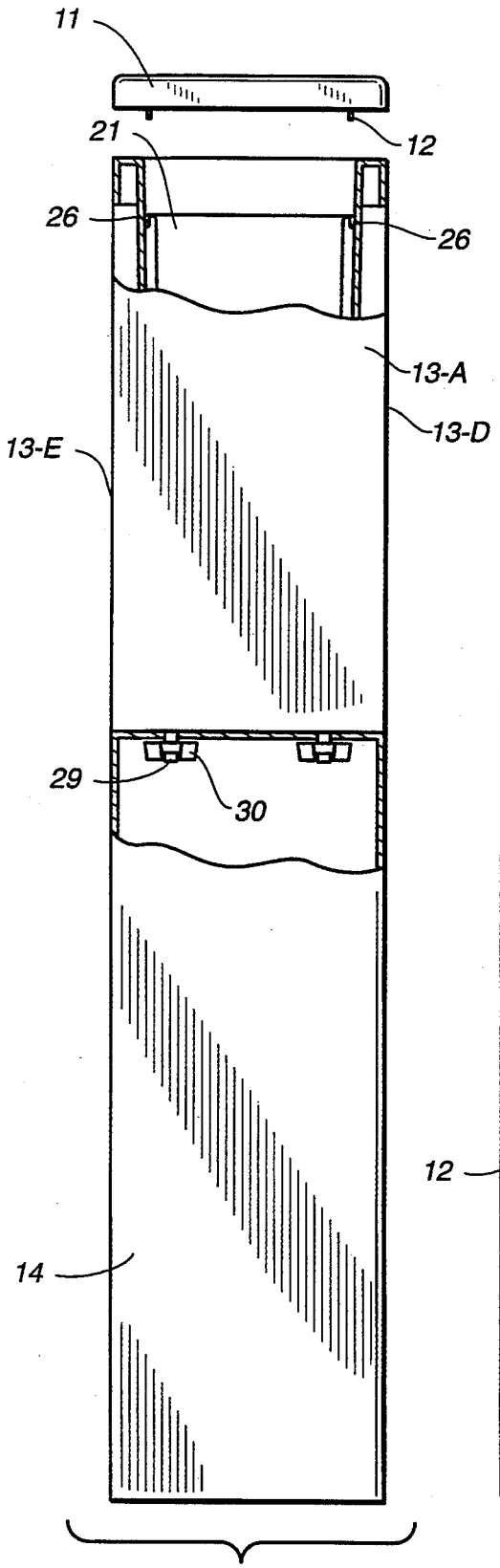

FIG. 7 shows a front view of the assembled LAUNDRY AREA ORGANIZER with cover 11 above. A section at the top of the leg 14 is cut away to show the attachment to the bin 13. A section of the front 13-A is cut away at the top to show a divider panel 21 close to meeting the divider ear seats 26. When fully lowered, the divider panel 21 will effectively create an isolated compartment on either side.

Figure 8:
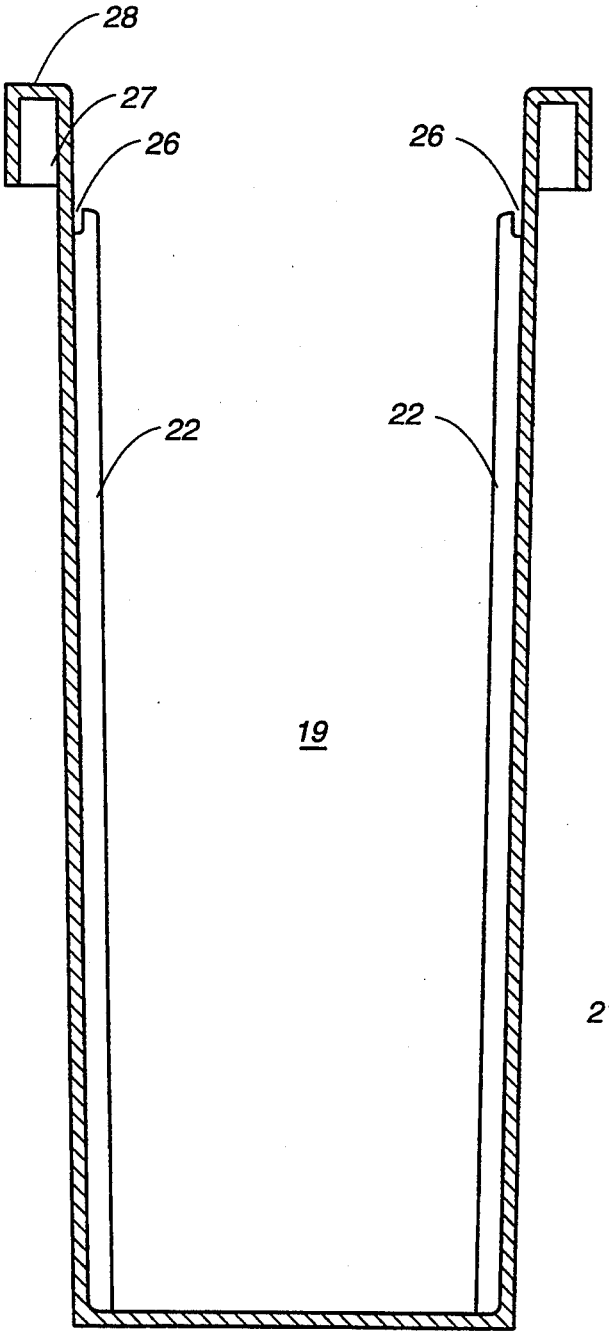

FIG. 8 is a cross section of the bin 13 on line A—A in FIG. 6, and shows in greater clarity the divider ear seats 26 at the top of interior rib/divider panel retainers 22, which engages the divider panel ears 21-A, (FIGS. 9 and 10), when the divider panel 21 is fully lowered. This position helps to keep the divider panel in place and resists lateral spreading of the bin 13 due to pressures imposed by its contents. The side channels 28 with their bridging ribs 27 also combine to resist spreading in between or in the absence of the divider panels 21.

Figure 9:
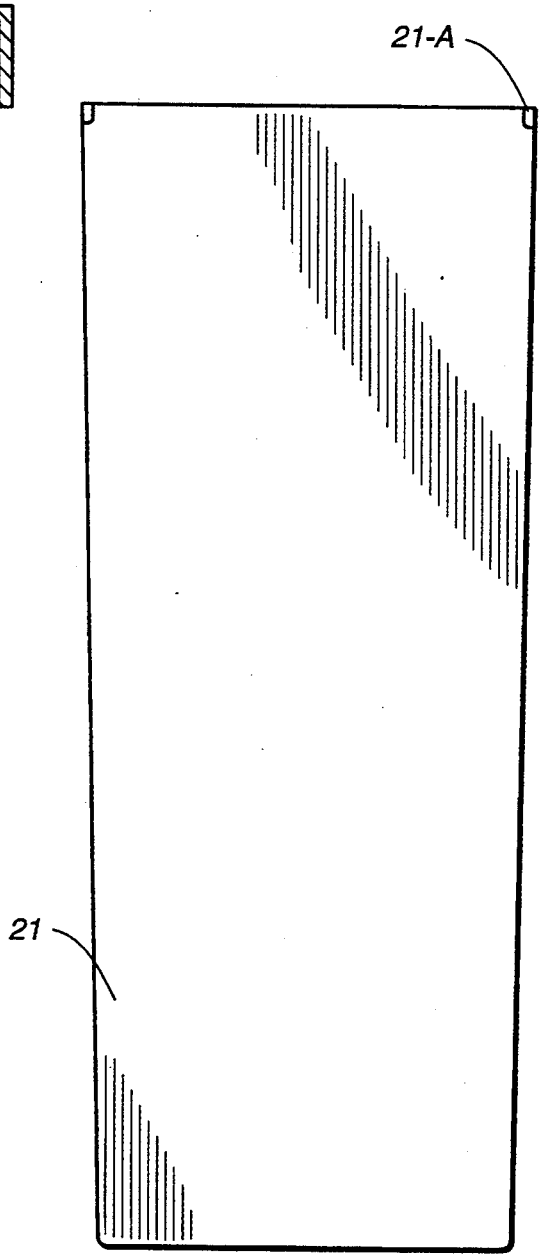
Figure 10:
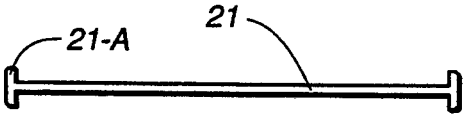

FIGS. 9 and 10 show a divider panel 21 from front and top respectively. The divider panel ears 21-A can be seen in both.

Figure 11:
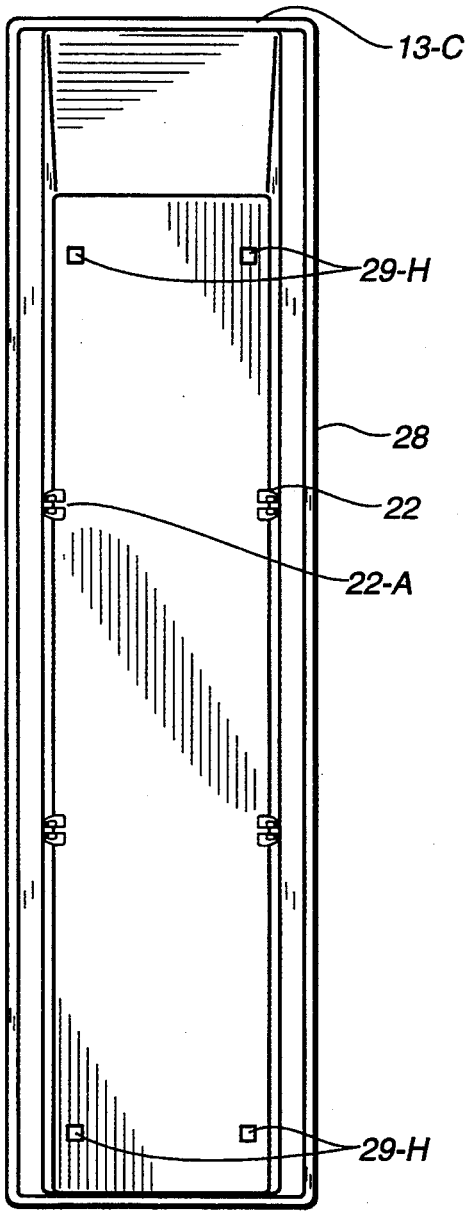

FIG. 11 is a view down into the chamber 19 of the bin 13. Two sets of laterally opposed pairs of interior rib/divider panel retainers 22 are shown, each pair combining to create a divider panel slot 22-A. Four bolt holes 29-H are square to receive the carriage bolts and prevent them from turning as the wing nuts 30 are tightened. Preferably a small amount of flash is left in the holes in the molding process to encourage the carriage bolts 29-H to stay in place while the wing nuts 30 are started.

FIG.12 is a bottom view of the bin 13. The bridging ribs 27 of the side channels 28 are exposed. Also shown are the bin locating recesses 24-R. The bin front 13-A, which is of a uniform width, can be seen to extend beyond the bottom of the bin 13, which is narrower because of the side channels 28 and the draft in the bin sides necessary for the injection molding process.

Figure 13:
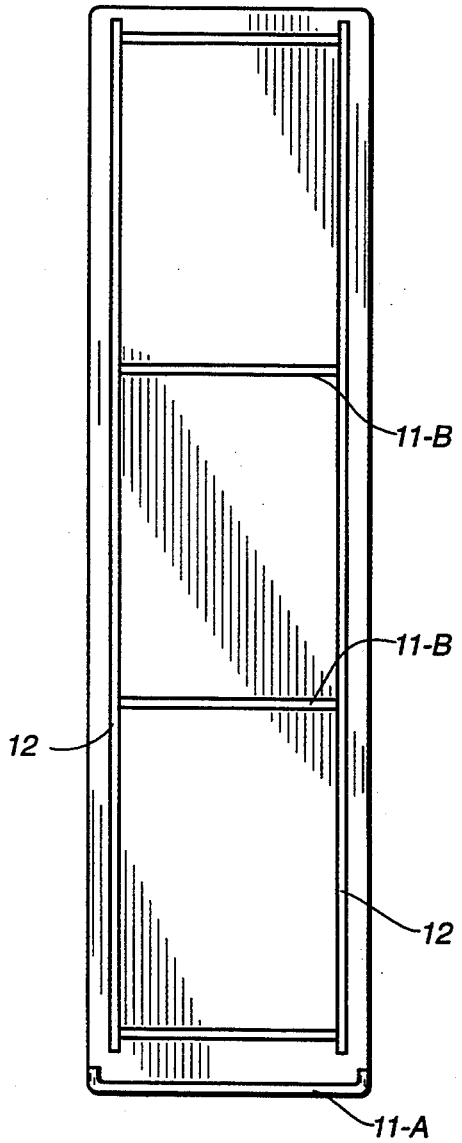

FIG. 13 shows the cover 11 from the bottom view. The structure of the handle 11-A is evident. Also show in FIG. 13 are the structural ribs 11-B that laterally support and strengthen the guides 12. The overall width of the cover 11 ideally is slightly less than that of the bin 13 to avoid clearance problems with the adjacent appliances as the cover 11 is raised and lowered in use.

Assembly amounts to attaching the legs 14 to the bin 13 with carriage bolts 29 and wing nuts 30. The locating ribs 23, locating bosses 24-B, and locating recesses 24-R align the parts and make it easy to push the bolts 29 in and install the nuts 30. The divider panels 21 can then be slid in the divider panel slots 22-A to configure the storage chamber 19 as desired.

Following assembly, the clothes washer and dryer are moved apart as required to create adequate space between them for the LAUNDRY AREA ORGANIZER, which can then be slid into the space thus created. This is an appropriate time to check and level the appliances as required per the manufacturer's instructions to achieve reasonable alignment of the upper surfaces of the three units. The appliances can then be moved in to provide the lateral support and stability required by the LAUNDRY AREA ORGANIZER.

The divider panel 21 configuration should be considered relative to intended use. As needs change so can the configuration of the panels. For example, if one compartment 19-A, 19-B, or 19-C is filled with powdered detergent and a bit more room is required to empty the package so it can be disposed of, a divider panel can be removed to instantly create a larger compartment.

The capacity of the storage chamber 19 of the preferred embodiment described is adequate for holding a 40-pound 5 gallon bucket of powdered detergent with some reserve. In this use, the rear divider can be inserted to hold a sizeable reserve. When the front area is empty, it's time to think about restocking. However the reserve makes running out before a trip to the store unlikely, even for rural residents who might go to town. only once a month.

With one divider in either position, the larger compartment thus formed will hold most units of powdered detergent in the 18- to 24-pound range with a reserve. Any of the smaller compartments possible in the embodiment described will hold units of powdered detergent or dry bleach up to about 18 pounds, depending on density. Any of the three compartments will also hold most 64-oz. liquid units of detergent or fabric softener, or most of the units of pre-wash stain removers available. A very large roll of 150 dryer sheets stores neatly in any compartment.

The options are varied. If softener, dryer sheets, etc. are used in addition to powdered detergent, one divider panel 21 can be inserted, the front compartment filled, and any surplus put where it is well out of the way, as a large supply is now on hand inches from the washer. The middle compartment can hold dry bleach or liquid softener, with dryer sheets, etc. in the rear.

If liquid detergent is used, a 64-oz. plastic jug can be stored in any compartment, holding a several week's supply. This is a handy size and easy to dispense from. Most come with a measuring cap. Even more economy can sometimes be had by purchasing up to 2-gallon jugs. These can be stored well out of the way and used to refill the 64-oz. jug kept in the LAUNDRY AREA ORGANIZER. Liquid fabric softener can likewise be purchased in larger units and used to refill the handier size. One softener manufacturer now offers refills in milk carton packaging for their 60-oz. plastic jug.

Figure 14:
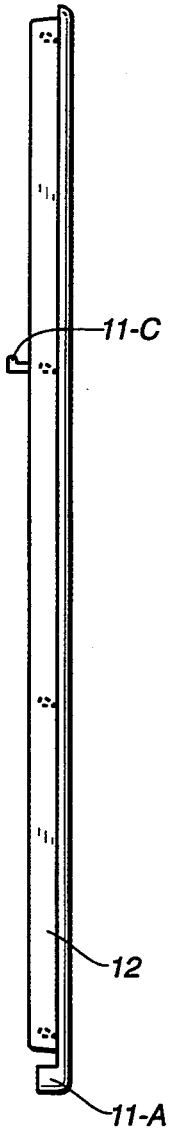

The cover 11 can be removed completely for loading, or if a cover hook 11-C (FIG. 14) has been molded in or installed, the cover 11 can be hung on the upper back 13-C if the unit is positioned a few inches from the wall behind. Loading powdered agents is easy to control, even from very large containers, as the weight can be born by the top of the washer or dryer. Loading is facilitated, especially if pouring into one of the small compartments, by placing a single sheet of newspaper on top of the opposite appliance and allowing it to hang into the compartment a few inches, wrapping around the front and back a bit. This has a funnel affect, guiding the powder into the compartment that might otherwise go past or to the sides.

Dispensing powders is done with the appropriate size scoop while holding the cover 11 in a raised position. The current embodiment is so configured size-wise that almost any adult and most children who are old enough to help with the laundry can easily access any possible compartment, top to bottom. After dispensing, the scoop can be dropped in, ready for the next use, and the cover returned to place. The guides 12 facilitate this.

While the present preferred embodiment incorporates the features just described, additional variations can be effected to further increase the usefulness and versatility of the LAUNDRY AREA ORGANIZER. Two of these embodiments are directed at making use of the space beneath the bin 13.

Figure 15:
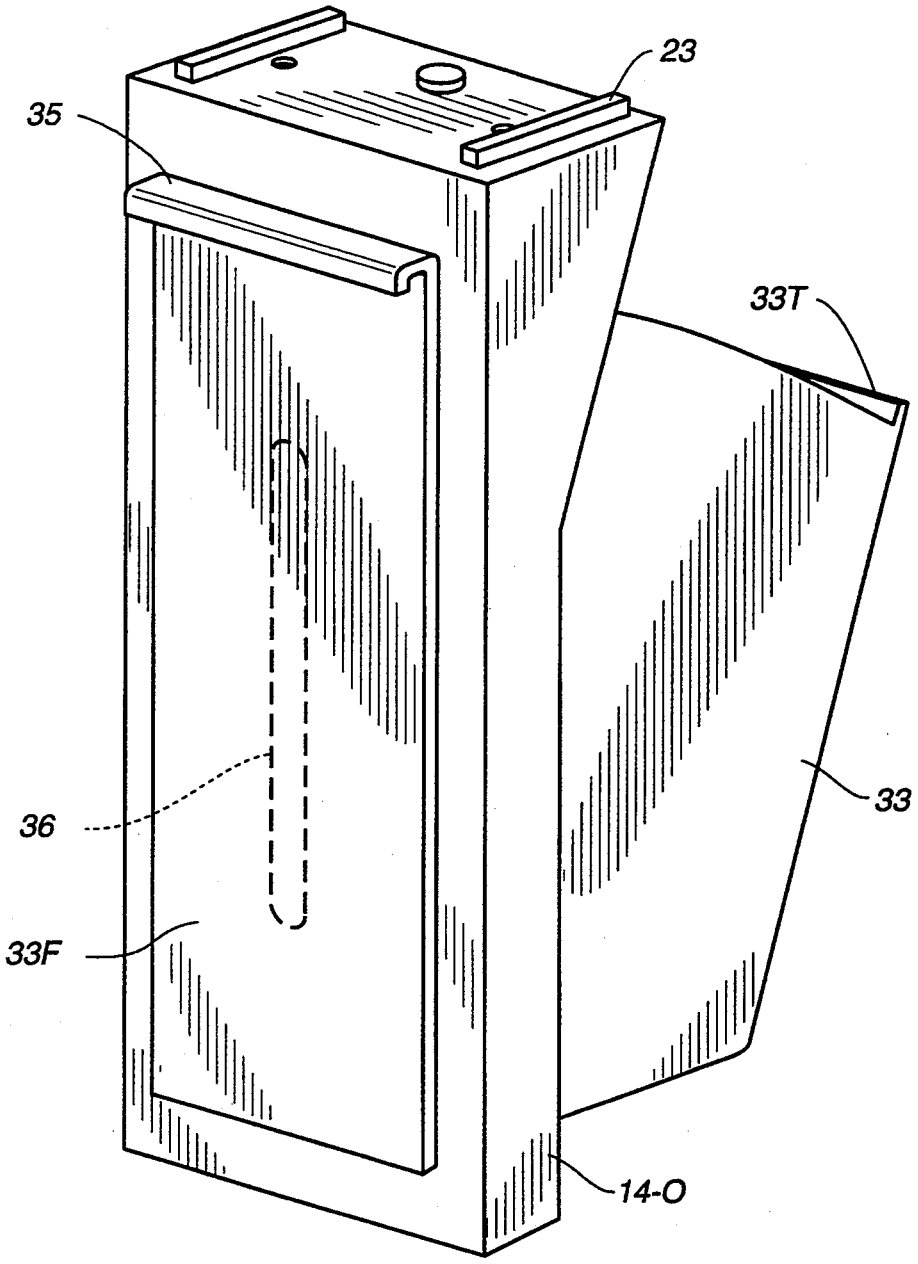
Figure 16:
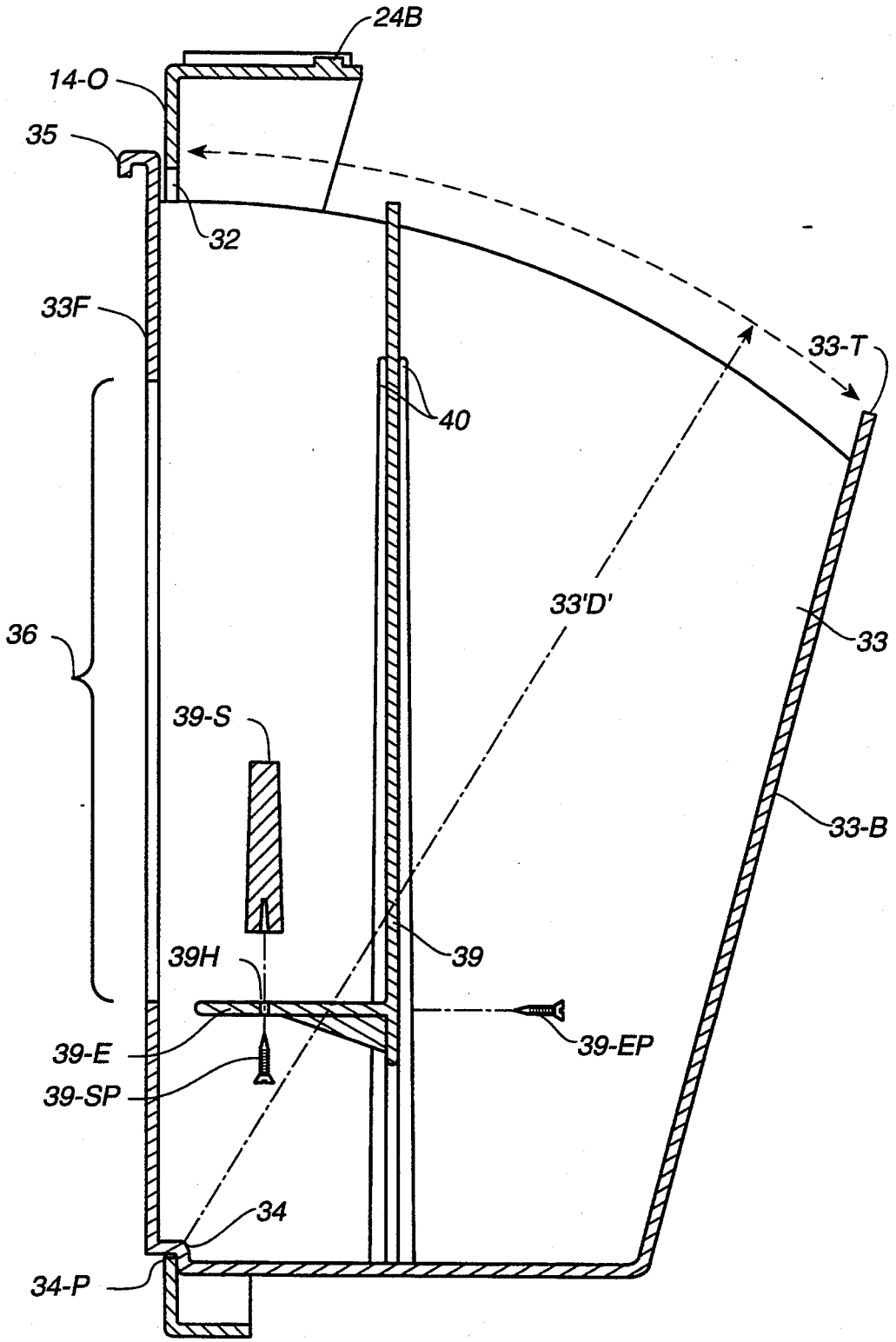

FIG. 15 and the cross section FIG. 16 show a front leg with rectangular opening 14-O into which is fitted a refuse container 33. The design of this arrangement relies on a pivot step 34 which allows the refuse container 33 to be inserted into the opening 32 by holding it level and pushing it in until the pivot step 34 drops over the bottom edge of the opening 32 in the leg 14-O, which effectively becomes the pivot point 34-P. The container 33 then may be tilted out by a handle 35 until the top of the back 33-T, which extends above the sides, acts as a stop against the leg 14-O. The distance from the pivot point 34-P to the top of the back 33-T is greater than to the top of the opening 32.

Once tilted out, the refuse container will stay open. Given a nudge, it will close with the refuse container front 33-F, which overlaps the opening 32 on sides and top, acting as a stop. The refuse container 33 is easily removed for emptying by lifting up until the pivot step 34 clears the opening bottom edge at 34-P, then pulling the container out level.

A further improvement contemplated and shown in FIGS. 15 and 16 allows dispensing of sheet materials such as dryer sheets from carton or roll through a slot 36 in the refuse container front 33-F, shown by broken lines in FIG. 15. This is facilitated by a bracket 39 that preferrably slides into slots created by opposing pairs of retainer ribs 40 projecting from the interior side walls of the refuse container 33. The vertical member of the bracket 39 keeps other contents of the container segregated from the dryer sheets and this arrangement allows quick removal of the assembly before emptying the container. The carton of sheets is dropped, with the dispensing opening of the carton facing the slot 36, into the space between the container front 33-F and the bracket 39 to be supported at the desired height by the horizontal extension 39-E of the bracket 39, whereby sheets can be withdrawn from the carton through the slot 36. Alternatively, a spindle 39-S, could be attached, preferrably by a pan head screw 39-SP through screw hole 39-H in bracket extension 39-E. The bracket extension 39-E would be fixed to the vertical member of the bracket 39 or detachably fixed, preferrably by one or more screws 39-EP passing through one or more holes to allow height adjustment of the sheet materials to be dispensed.

Figure 17:
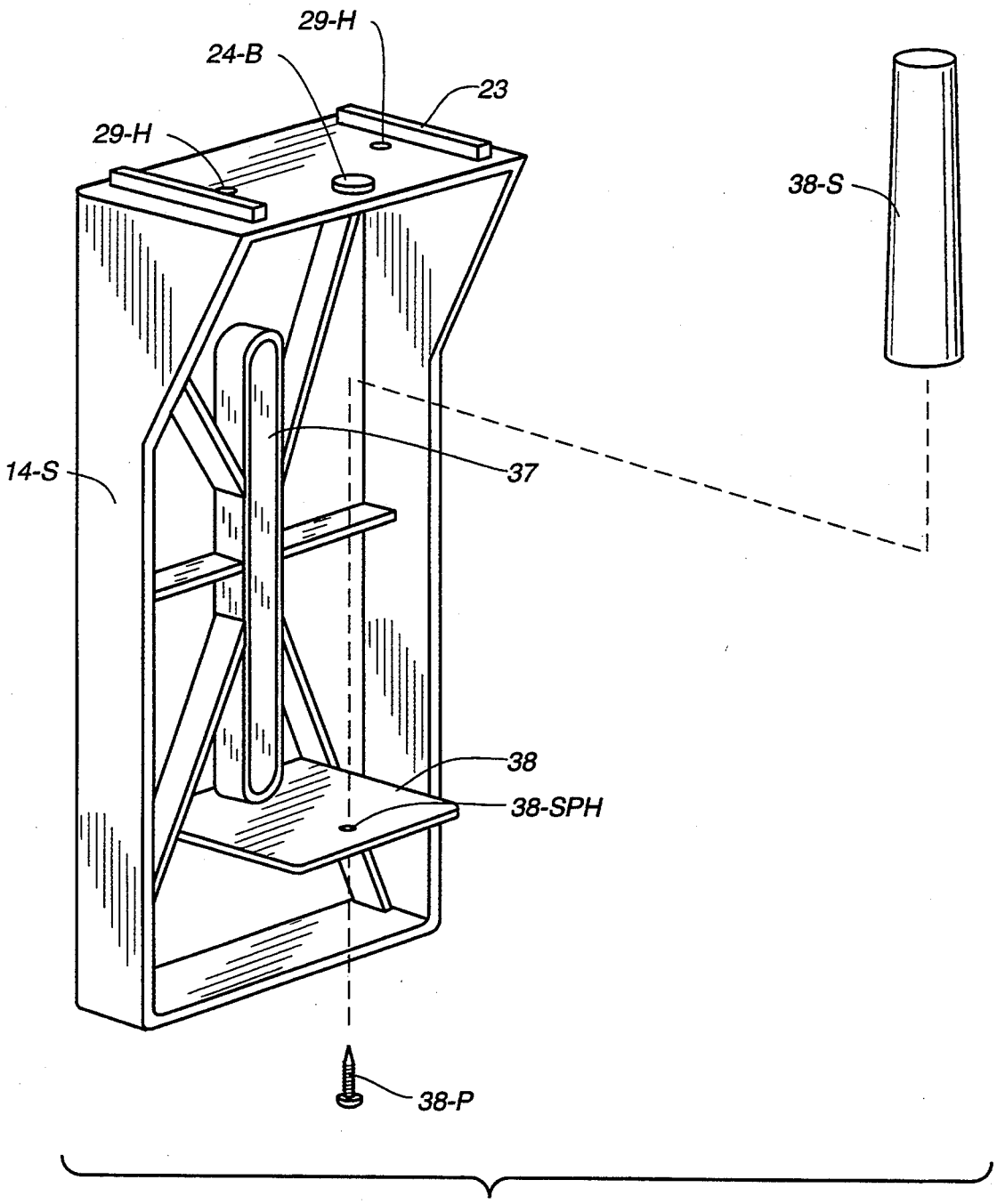
Figure 18:
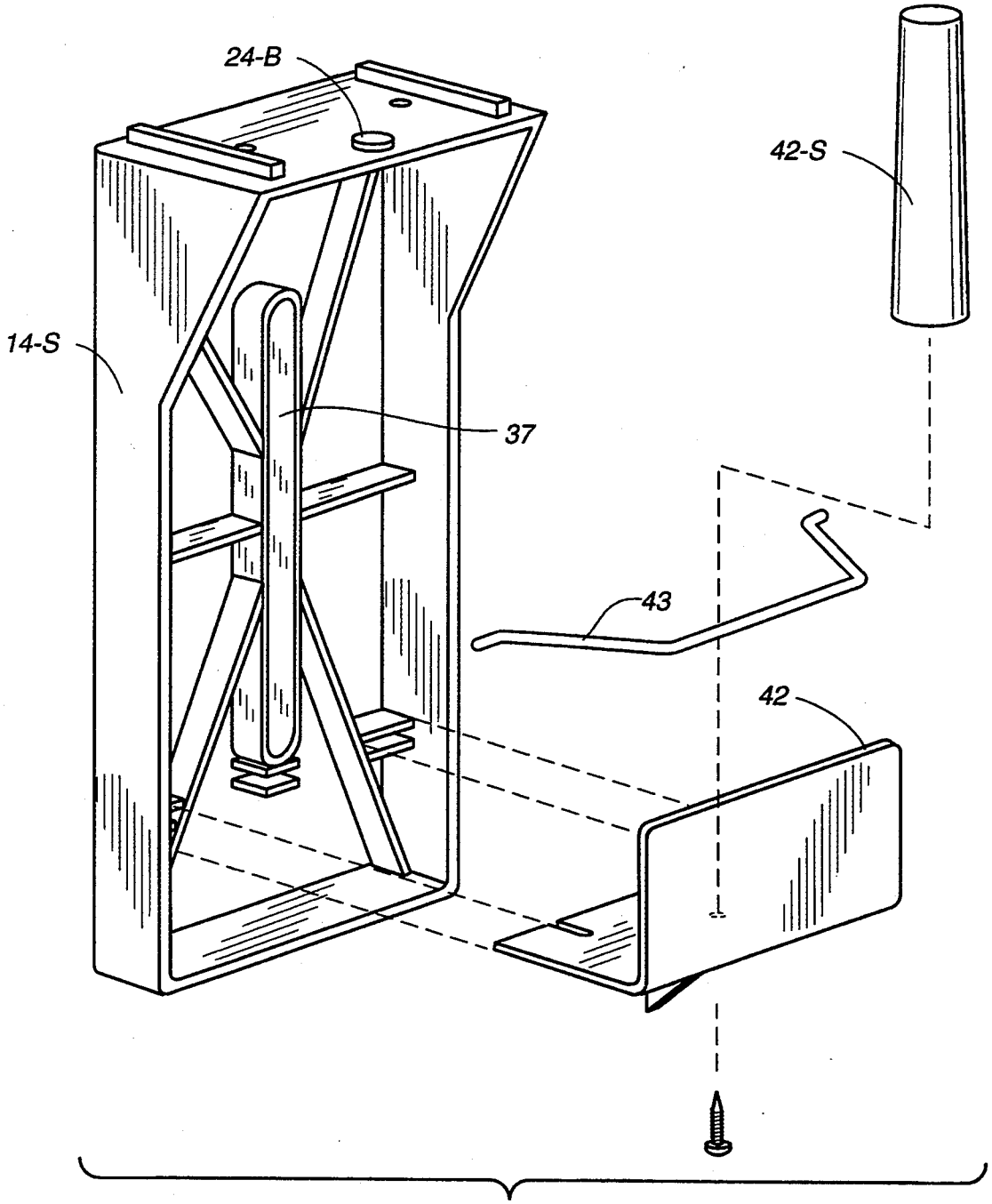

FIGS. 17 and 18 illustrate alternate embodiments for increasing the versatility of the LAUNDRY AREA ORGANIZER by offering dispensing of sheet materials through a slot 37 in a front leg 14-S. The unit might be furnished with one leg 14 without a slot and one leg 14-S with a slot, otherwise interchangeable, allowing the user to choose the dispenser option or not. The sheet materials are stored for dispensing behind the leg 14-S on a bracket 38 (FIG. 17) or 42 (FIG. 18) having a spindle 38-S (FIG. 17) or 42-S (FIG. 18) that allows a roll of sheet materials to rotate when sheets are withdrawn through the slot 37.

In FIG. 17, the bracket 38 is integrally molded into the back side of the leg 14-S, and the spindle 38-S is attached, preferably by a pan-head screw 38-SP through a hole 38-SPH in the bracket 38.

FIG. 18 shows a front leg with slot 14-5 with removable bracket and detachable or integrally molded spindle, or adjustable vertical extension or wire bale 43 for holding sheet materials in place for dispensing.

The result of the embodiments of FIG. 17 or FIG. 18 is the easy dispensing of dryer sheet fabric softener 8 to 10 inches from the dryer door.

The foregoing has described the preferred embodiment and several alternative configurations of the LAUNDRY AREA ORGANIZER. It is understood that a skilled workman would be able to further alter the invention to suit particular needs and circumstances without departing from the spirit of the invention. For example, the cover 11 can be hinged at a distal edge to the back panel. Also, the legs can be provided with holes to accommodate screw-in rubber capped feet to offer adjustment of height so that the top surface of the cover 11 is flush with the top surfaces of the clothes washer and dryer. Accordingly the protection to be afforded this invention is to be determined from the claims appended hereto. The embodiments of the invention in which an exclusive property or privilege is claimed are defined as follows:

What is claimed is:

1. A laundry area organizer for use with a clothes washer and dryer, each of the clothes washer and dryer having a top surface and side walls, the laundry area organizer configured to be located between the clothes washer and dryer, the laundry area organizer comprising:

a bin comprising a front, a back, a bottom, first and second side walls, and an open top, the first side wall of the bin being juxtaposed to and abutted with a side wall of one of the clothes washer and dryer and the second side wall of the bin being juxtaposed to and abutted with a side wall of the other of the clothes washer and dryer so that the bin is disposed between and laterally supported by the clothes washer and dryer, the front, back, and first and second side walls of the bin defining an interior chamber;

a cover for the bin open top, the cover having a top surface, the cover being manipulable to an open position for providing access to the interior of the bin and, alternatively, to a closed position for precluding access to the interior of the bin; and a plurality of legs for the bin for vertically supporting the bin so that the top surface of the cover is at about the same height as the top surfaces of the clothes washer and dryer so that the top surfaces of the cover and the clothes washer and dryer lie approximately in a plane when the cover is in the closed position;

the height of the laundry area organizer being substantially greater than the width of the laundry area organizer for convenient location of the laundry area organizer between the clothes washer and dryer to allow the clothes washer and dryer to remain in close proximity so that the transfer of clothes from the washer to the dryer is not substantially impeded, the laundry area organizer having a high center of gravity when the laundry area organizer is filled with laundering agents, the laundry area organizer relying on abutting contact of the first and second side walls of the bin with the juxtaposed side walls of the clothes washer and dryer for lateral support to overcome the instability created by the high center of gravity and high ratio of height to width.

2. The laundry area organizer of claim 1 wherein the cover is removable from the bin.

3. The laundry area organizer of claim 1 wherein one of the legs is provided with an opening, further comprising:

a refuse container disposed in the opening in the one leg, the refuse container being manipulable between a closed position and an open position.

4. The laundry area organizer of claim 3 wherein the refuse container comprises first and second sides, a back, a bottom, and a front having vertical edges which extend outwardly from a junction of the front of the refuse container with the first and second sides of the refuse container and a pivot step disposed at a junction of the front of the refuse container and the bottom of the refuse container, and wherein the opening in the one leg has a pivot point at a bottom edge of the opening for pivotally contacting the pivot step of the refuse container when the refuse container is disposed in the opening in the one leg, the vertical edges of the front of the refuse container extending transversely of vertical edges of the opening in the front of the one leg so that the front of the refuse container does not pass through the opening in the one leg when the pivot step pivots on the pivot point as the refuse container is manipulated to the closed position.

5. The laundry area organizer of claim 1 wherein the back of the refuse container comprises a top portion and the opening in the one leg has a top edge, the top portion of the back of the refuse container extending vertically of the top edge of the one leg so that the back of the refuse container does not pass through the opening in the one leg when the pivot step pivots on the pivot point as the refuse container is manipulated to the open position.

6. The laundry area organizer of claim 3 wherein the refuse container comprises first and second sides, a back, and a bottom, further comprising:

a pair of bracket retainer ribs, the pair of bracket retainer ribs comprising a first bracket retainer slot integral with the first side of the refuse container on the interior of the refuse container and a second bracket retainer slot integral with the second side of the refuse container and opposite the first bracket retainer slot on the interior of the refuse container; and a bracket for being selectively inserted into the pair of bracket retainer ribs, the bracket comprising a vertical portion and a horizontal portion extending away from the vertical portion toward the front of the refuse container; and a holding means attached to the horizontal portion of the bracket for holding sheet material; and wherein the front of the refuse container comprises a vertical slot through which the sheet material extends when the sheet material is retained by the holding means.

7. A laundry area organizer for use with a clothes washer and dryer, each of the clothes washer and dryer having a top surface and side walls, the laundry area organizer configured to be located between the clothes washer and dryer, the laundry area organizer comprising:

a bin comprising a front, a back, a bottom, and first and second side walls, the first side wall of the bin being juxtaposed to and abutted with a side wall of one of the clothes washer and dryer and the second side wall of the bin being juxtaposed to and abutted with a side wall of the other of the clothes washer and dryer so that the bin is disposed between and laterally supported by the clothes washer and dryer, the front, back, and first and second side walls of the bin defining an interior chamber, the back of the bin comprising an upper back portion and a lower back portion integral with the upper back portion, the lower back portion being offset inwardly from a junction of the upper back portion with the lower back portion to a junction of the lower back portion with the bottom of the bin;

a cover for the bin, the cover having a top surface, the cover being manipulable to an open position for providing access to the interior of the bin and, alternatively, to a closed position for precluding access to the interior of the bin; and a plurality of legs for the bin for vertically supporting the bin so that the top surface of the cover is at about the same height as the top surfaces of the clothes washer and dryer so that the top surfaces of the cover and the clothes washer and dryer lie approximately in a plane, a first leg being selectively attached to the bin so that a front surface of the first leg is approximately flush with the front of the bin a second leg being selectively attached to the bin so that the back surface of the second leg is offset toward the first leg due to the inward offset of the lower portion of the lower back portion of the back of the bin to accommodate connection of the clothes washer and dryer to utilities behind the bin.

8. The laundry area organizer of claim 7 wherein the first and second legs each comprise at least one locating rib and at least one locating boss and the bottom of the bin comprises at least one locating recess so that the at least one locating rib contacts one of the first and second side walls and the at least one locating boss interfits within the at least one locating recess when each of the first and second legs are attached to the bin.

9. The laundry area organizer of claim 1 wherein the one of the legs is provided with an opening, further comprising:

a refuse container disposed in the opening in the one leg, the refuse container being manipulable between a closed position and an open position.

10. The laundry area organizer of claim 7 wherein the bottom of the bin comprises a plurality of bolt holes and the first and second legs each comprise a plurality of bolt holes, further comprising a plurality of bolts inserted through aligned bolt holes in the bin and first and second legs and wing nuts secured to the inserted bolts to attach the first and second legs to the bin.

11. The laundry area organizer of claim 9 wherein the refuse container comprises first and second sides, a back, and a bottom, further comprising:

a pair of bracket retainer ribs, the pair of bracket retainer ribs comprising a first bracket retainer slot integral with the first side of the refuse container on the interior of the refuse container and a second bracket retainer slot integral with the second side of the refuse container and opposite the first bracket retainer slot on the interior of the refuse container; and a bracket for being selectively inserted into the pair of bracket retainer ribs, the bracket comprising a vertical portion and a horizontal portion extending away from the vertical portion toward the front of the refuse container; and a holding means attached to the horizontal portion of the bracket for holding sheet material; and wherein the front of the refuse container comprises a vertical slot through which the sheet material extends when the sheet material is retained on the holding means.

12. The laundry area organizer of claim 7, further comprising:

a bracket attached to an interior surface of the one leg; and a holding means attached to the bracket for holding sheet material; and wherein the front of the one leg comprises a slot through which the sheet material extends when the sheet material is retained on the holding means.

13. The laundry area organizer of claim 1 wherein the cover has lateral edges and comprises:

a handle integral with the cover, the handle being positioned proximate the front of the bin to facilitate manipulation of the cover; and structural ribs disposed proximate the lateral edges of the cover.

14. The laundry organizer of claim 1, further comprising:

at least one pair of divider panel slots, the pair of divider panel slots comprising a first divider panel slot integral with the first side wall of the bin on the interior of the bin and a second divider panel slot integral with the second side wall of the bin and opposite the first divider panel slot on the interior of the bin; and a divider panel for being selectively inserted into the at least one pair of divider panel slots to divide the interior chamber of the bin into a plurality of compartments.

15. The laundry area organizer of claim 1 wherein the bin has lateral edges and the bin further comprises side channels disposed along the lateral edges of the bin.

16. A laundry area organizer for use with a clothes washer and dryer, each of the clothes washer and dryer having a top surface and side walls, the laundry area organizer configured to be located between the clothes washer and dryer, the laundry area organizer comprising:

a bin comprising a front, a back, a bottom, first and second side walls, and an open top, the first side wall of the bin being juxtaposed to and abutted with a side wall of one of the clothes washer and dryer and the second side wall of the bin being juxtaposed to and abutted with a side wall of the other of the clothes washer and dryer so that the bin is disposed between and laterally supported by the clothes washer and dryer, the front, back, and first and second side walls of the bin defining an interior chamber;

a cover for the bin open top, the cover having a top surface, the cover being manipulable to an open position for providing access to the interior of the bin and, alternatively, to a closed position for precluding access to the interior of the bin; a plurality of legs for the bin for vertically supporting the bin so that the top surface of the cover is at about the same height as the top surfaces of the clothes washer and dryer so that the top surfaces of the cover and the clothes washer and dryer lie approximately in a plane when the cover is in the closed position;

the height of the laundry area organizer being substantially greater than the width of the laundry area organizer for convenient location of the laundry area organizer between the clothes washer and dryer to allow the clothes washer and dryer to remain in close proximity so that the transfer of clothes from the washer to the dryer is not substantially impeded, the laundry area organizer having a high center of gravity when the laundry area organizer is filled with laundering agents, the laundry area organizer relying on abutting contact of the first and second side walls of the bin with the juxtaposed side walls of the clothes washer and dryer for lateral support to overcome the instability created by the high center of gravity and high ratio of height to width, one of the legs being provided with an opening;

a refuse container disposed in the opening in the one leg, the refuse container being manipulable between a closed position and an open position, the refuse container comprising first and second sides, a back, and a bottom;

a holding means selectively mounted in the interior of the refuse container for holding sheet material; and wherein the front of the refuse container comprises a vertical slot through which the sheet material extends when the sheet material is retained by the holding means.

17. The laundry area organizer of claim 11 wherein the one leg is attached to the bin so that a front surface of the one leg is approximately flush with the front of the bin.

18. The laundry area organizer of claim 16 wherein the refuse container comprises first and second sides, a back, a bottom, and a front having vertical edges which extend outwardly from a junction of the front of the refuse container with the first and second sides of the refuse container and a pivot step disposed at a junction of the front of the refuse container and the bottom of the refuse container, and wherein the opening in the one leg has a pivot point at a bottom edge of the opening for pivotally contacting the pivot step of the refuse container when the refuse container is disposed in the opening in the one leg, the vertical edges of the front of the refuse container extending transversely of vertical edges of the opening in the front of the one leg so that the front of the refuse container does not pass through the opening in the one leg when the pivot step pivots on the pivot point as the refuse container is manipulated to the closed position.

19. The laundry area organizer of claim 18 wherein the back of the refuse container comprises a top portion and the opening in the one leg has a top edge, the top portion of the back of the refuse container extending vertically of the top edge of the one leg so that the back of the refuse container does not pass through the opening in the one leg when the pivot step pivots on the pivot point as the refuse container is manipulated to the open position.

20. The laundry area organizer of claim 1, further comprising:

a bracket attached to an interior surface of the one leg; and a holding means attached to the bracket for holding sheet material; and wherein the front of the one leg comprises a slot through which the sheet material extends when the sheet material is retained by the holding means.

* * * * *